US012551035B2

(12) United States Patent
Xu et al.

(10) Patent No.: US 12,551,035 B2
(45) Date of Patent: Feb. 17, 2026

(54) BREATHABLE BEDDING AND METHOD FOR PRODUCING SAME

(71) Applicant: HANGZHOU JISENCHUAN TRADING CO., LTD, Hangzhou (CN)

(72) Inventors: Shengping Xu, Hangzhou (CN); Yanze Xu, Hangzhou (CN)

(73) Assignee: HANGZHOU JISENCHUAN TRADING CO., LTD, Hangzhou (CN)

( * ) Notice: Subject to any disclaimer, the term of this patent is extended or adjusted under 35 U.S.C. 154(b) by 157 days.

(21) Appl. No.: 18/393,730

(22) Filed: Dec. 22, 2023

(65) Prior Publication Data

US 2024/0415302 A1 Dec. 19, 2024

(30) Foreign Application Priority Data

Jun. 14, 2023 (CN) ..... 202310713908.6

(51) Int. Cl.
*A47G 9/02* (2006.01)
*A47C 27/12* (2006.01)
*A47G 9/10* (2006.01)

(52) U.S. Cl.
CPC ..... *A47G 9/02* (2013.01); *A47C 27/12* (2013.01); *A47G 9/10* (2013.01)

(58) Field of Classification Search
CPC ..... A47G 9/02; A47G 9/10; A47G 9/0207; A47C 27/12; B68G 7/06; B68G 7/08
USPC ..... 5/724
See application file for complete search history.

(56) References Cited

U.S. PATENT DOCUMENTS 5,095,569 A * 3/1992 Glenn ..... A47G 9/10 5/490
9,788,661 B1 * 10/2017 Alletto ..... A47C 21/042
2021/0106153 A1 * 4/2021 Francescatto ..... A47G 9/0238

FOREIGN PATENT DOCUMENTS

CN 101028160 A 9/2007
CN 105128442 A 12/2015
CN 207012017 U * 2/2018
CN 211354829 U * 8/2020
DE 102009005783 A1 7/2010
JP 2009100864 A 5/2009
(Continued)

OTHER PUBLICATIONS

The European search report of EP patent application No. 23833297.7 issued on May 16, 2025.
(Continued)

*Primary Examiner* — David R Hare
*Assistant Examiner* — George Samuel Gines
(74) *Attorney, Agent, or Firm* — Andrew C. Cheng

(57) ABSTRACT

The present application provides a breathable bedding and a method for producing the same. The method for producing a breathable bedding includes the following steps: producing a cover, wherein the cover includes a first fabric layer and a second fabric layer which are stacked from top to bottom, the cover is divided into filling areas and breathable areas, and the filling areas and the breathable areas are separated from each other; conducting air-permeable treatment to the breathable areas to form air-permeable structure in the breathable areas; filling cotton between the first fabric layer and the second fabric layer in the filling areas; and sewing the first fabric layer and the second fabric layer at the edge of the cover to obtain a breathable bedding.

11 Claims, 12 Drawing Sheets

(56) References Cited

FOREIGN PATENT DOCUMENTS

| | | | | | |
|---|---|---|---|---|---|
| KR | 200377147 | Y1 | | 3/2005 | |
| KR | 20080004416 | U | | 10/2008 | |
| KR | 20110022943 | A | | 3/2011 | |
| KR | 20180008174 | A | * | 1/2018 | ..... B68G 7/08 |
| KR | 20200045687 | A | * | 5/2020 | ..... D03D 11/02 |
| RU | 200178 | U1 | | 10/2020 | |
| WO | WO-2022035346 | A1 | * | 2/2022 | ..... A47G 9/0207 |

OTHER PUBLICATIONS

International search report of PCT patent application No. PCT/CN2023/109209 issued on Feb. 7, 2024.

* cited by examiner

BREATHABLE BEDDING AND METHOD FOR PRODUCING SAME

TECHNICAL FIELD

This application relates to the field of bedding technology, and in particular, to a breathable bedding and its production method.

BACKGROUND

Quilt is a necessary bedding for families, used to keep people warm while sleeping. In the hot summer, people are accustomed to sleeping with the air conditioning on, and they need to prepare blankets to keep warm in bed. However, in the hot weather conditions of summer, the human body inevitably sweats more. If the breathability of the blankets is poor and the moisture in the bedding is high, it is easy to cause discomfort. Mesh breathable quilts are widely used because they can maintain a certain temperature and have good breathability.

Technical Problem

The existing mesh breathable quilt generally involves setting multiple hollow areas on the quilt cover (the hollow areas are formed by cutting the quilt cover), then setting mesh fabric in the hollow areas, sewing the mesh fabric together with the quilt cover, and finally filling the quilt cover with cotton to obtain the mesh breathable quilt. However, the mesh breathable quilt produced by this method not only has relatively poor structural strength and aesthetics (obtained by sewing the mesh fabric with the quilt cover), but also has complex production processes, low production efficiency, and high production cost.

Technical Solution

The object of the present application is to provide a method for producing a breathable bedding, which not only has a simple production process, but also the cover of the breathable bedding has an integrated structure, thereby improving the structural strength and aesthetics, and improving the production efficiency.

The present application provides a method for producing a breathable bedding, including the following steps:

- producing a cover, wherein the cover includes a first fabric layer and a second fabric layer which are stacked from top to bottom, the cover is divided into filling areas and breathable areas, and the filling areas and the breathable areas are separated from each other;
- conducting air-permeable treatment to the breathable areas to form air-permeable structure in the breathable areas;
- filling cotton between the first fabric layer and the second fabric layer in the filling areas; and
- sewing the first fabric layer and the second fabric layer at the edge of the cover to obtain a breathable bedding.

In an achievable manner, said conducting air-permeable treatment to the breathable areas to form air-permeable structure in the breathable areas, specifically includes:

perforating the breathable areas to form breathable holes in the breathable areas, wherein the breathable holes penetrate through the first fabric layer and the second fabric layer from top to bottom in the breathable areas.

In an achievable manner, said conducting air-permeable treatment to the breathable areas to form air-permeable structure in the breathable areas, specifically includes:

cutting the breathable areas to form breathable slits in the breathable areas, wherein the breathable slits penetrate through the first fabric layer and the second fabric layer from top to bottom in the breathable areas.

In an achievable manner, before conducting air-permeable treatment to the breathable areas, the surface of each breathable area is hot pressed with an adhesive film layer, and then the breathable area and the adhesive film layer are cut to form the breathable slits simultaneously in the breathable area and the adhesive film layer.

In an achievable manner, the breathable slits include a first breathable slit and a second breathable slit which are arranged in a mutually intersecting manner, and the breathable area forms a flipping portion at the intersection of the first breathable slit and the second breathable slit.

The present application further provides a method for producing a breathable bedding, including the following steps:

- producing a cover, wherein the cover is produced by weaving, the cover includes a first fabric layer and a second fabric layer which are stacked from top to bottom, the cover is divided into filling areas and breathable areas, and air-permeable structure is formed on the first fabric layer and the second fabric layer in the breathable areas during the weaving process;
- filling cotton between the first fabric layer and the second fabric layer in the filling areas; and
- sewing the first fabric layer and the second fabric layer at the edge of the cover to obtain a breathable bedding.

In an achievable manner, the cover is provided with multiple breathable areas, the multiple breathable areas are arranged in an array on the cover, and adjacent two breathable areas are separated by the filling areas.

In an achievable manner, the thickness of the breathable areas is less than the thickness of the filling areas, and the upper and lower sides of the breathable area are inward recessed compared to the upper and lower sides of the filling area.

In an achievable manner, after filling cotton between the first fabric layer and the second fabric layer in the filling areas, the first fabric layer and the second fabric layer in the filling areas are further sewn with sewing lines to fix the cotton between the first fabric layer and the second fabric layer in the filling areas.

In an achievable manner, the cover is provided with multiple breathable areas, the multiple breathable areas are arranged in an array on the cover, and adjacent two breathable areas are separated by the filling areas; the sewing lines are located between adjacent breathable areas, the sewing lines include multiple first sewing lines extending horizontally and multiple second sewing lines extending vertically, the breathable bedding is comprised of multiple cells formed by the multiple first sewing lines intersecting with the multiple second sewing lines, the multiple breathable areas are respectively located within the multiple cells, and each cell is a structure with a depression in the middle and a protrusion at the periphery.

The present application further provides a breathable bedding which is produced using the method for producing a breathable bedding described above.

In an achievable manner, the breathable bedding is a breathable quilt, breathable pillow, or breathable mattress.

Beneficial Effects

In the method for producing a breathable bedding provided in the present application, the cover is divided into filling areas and breathable areas, the filling areas and the breathable areas are separated from each other, air-permeable treatment is conducted to the breathable areas to form air-permeable structure in the breathable areas, and then, cotton is filled between the first fabric layer and the second fabric layer in the filling areas to obtain a breathable bedding. Due to the fact that the production method does not require cutting the cover to form hollow areas and sewing the mesh fabric with the cover, but directly conducts the air-permeable treatment to the breathable areas, thereby obtaining the breathable areas with air-permeable structure, not only the production process is simple, the production efficiency is high, and the production cost is saved (no cutting waste is generated, and there is also no need to provide additional mesh fabric), but also the cover of the entire breathable bedding has an integrated structure, thereby improving the structural strength and aesthetics while also providing good breathability and heat dissipation functions.

DETAILED DESCRIPTION OF THE EMBODIMENTS

Figure 1:
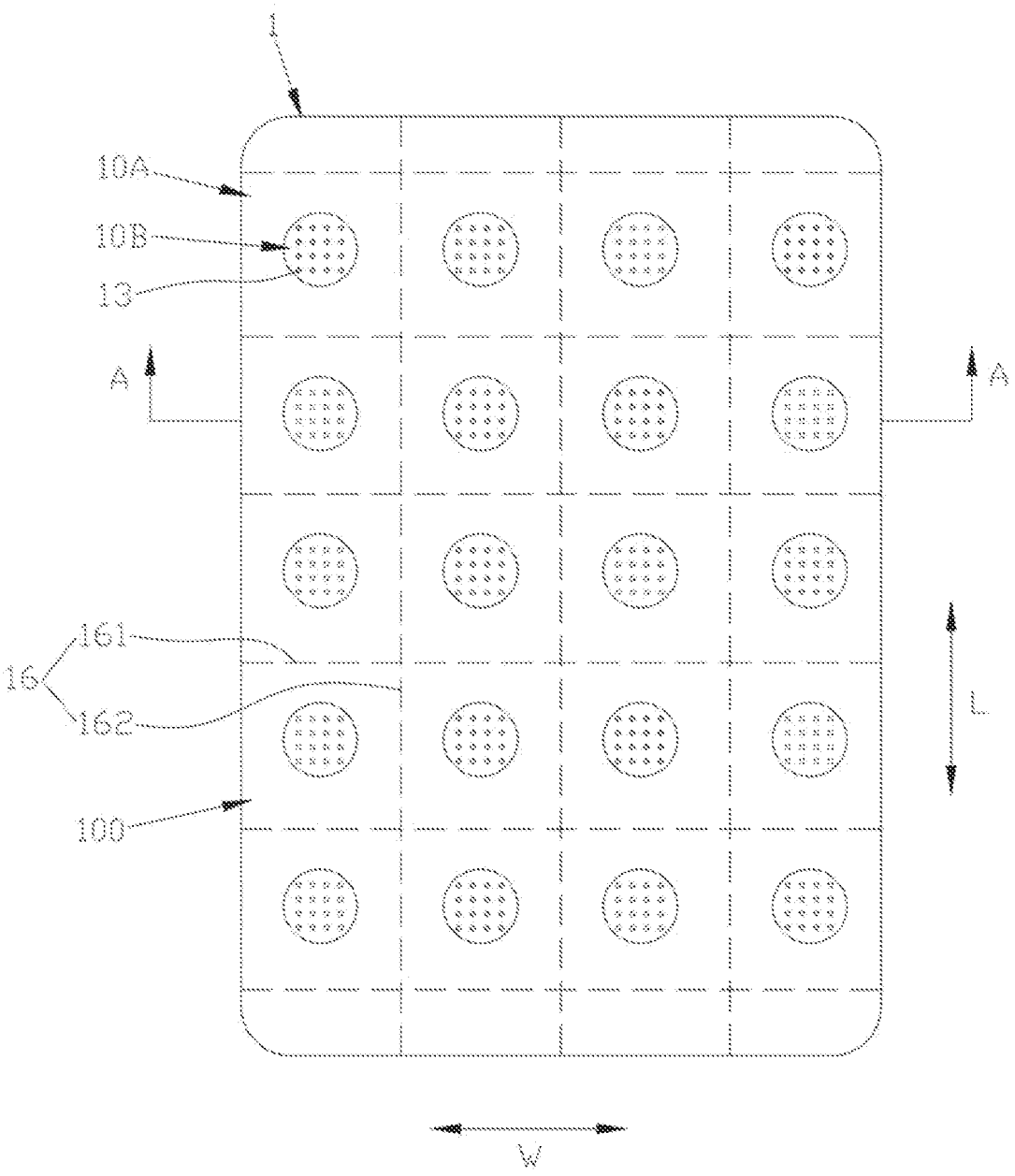
FIG. 1 is a schematic diagram of the planar structure of a breathable bedding in an embodiment of the present application.

The following will provide a further detailed description of the specific implementations of the present application in conjunction with the accompanying drawings and embodiments. The following embodiments are used to illustrate the present application, but are not intended to limit the scope of the present application.

The terms "first", "second", "third", "fourth", etc. (if any) in the specification and claims of the present application are only used to distinguish similar objects, and are not intended to be used to describe a specific sequence or order.

The terms "up", "down", "left", "right", "front", "back", "top", "bottom" (if any) mentioned in the specification and claims of the present application are defined based on the position of the structure in the figures and the position between the structures in the figures, only for the clarity and convenience of expressing the technical solution. It should be understood that the use of these directional words should not limit the scope of protection in the present application.

As shown in FIGS. 1 to 4 and FIGS. 9*a* to 12*b*, a method for producing a breathable bedding provided in this embodiment includes the following steps:

- S11: producing a cover 1, wherein the cover 1 includes a first fabric layer 11 and a second fabric layer 12 which are stacked from top to bottom, the cover 1 is divided into filling areas 10A and breathable areas 10B, and the filling areas 10A and the breathable areas 10B are separated from each other (to facilitate the subsequent filling of the cotton 2 and prevent the cotton 2 from entering the breathable areas 10B);
- S12: conducting air-permeable treatment to the breathable areas 10B to form air-permeable structure in the breathable areas 10B, wherein the air-permeable structure serves as a breathable heat dissipation function;
- S13: filling cotton 2 between the first fabric layer 11 and the second fabric layer 12 in the filling areas 10A, wherein in this step, since at least a position of the first fabric layer 11 and the second fabric layer 12 at the edge of the cover 1 has not been sewn yet, that is, an opening is formed between the first fabric layer 11 and the second fabric layer 12 at the edge of the cover 1, the cotton 2 can be filled into the cover 1 through the opening; and
- S14: sewing the first fabric layer 11 and the second fabric layer 12 at the edge of the cover 1 to obtain a breathable bedding.

It should be noted that the sequence of steps for filling the cotton 2 and sewing the edge of the cover 1 is not limited. The cotton 2 can be filled first and then the edge of the cover 1 is sewn; alternatively, the edge of the cover I can be first sewn, with a reserved filling port (for filling the cotton 2), then the cotton 2 is filled, and finally the filling port is sewn; alternatively, the cotton 2 can be filled while sewing the edge of the cover 1.

In the method for producing a breathable bedding provided in this embodiment, the cover 1 is divided into filling areas 10A and breathable areas 10B, the filling areas 10A and the breathable areas 10B are separated from each other, air-permeable treatment is conducted to the breathable areas 10B to form air-permeable structure in the breathable areas 10B, and then, cotton 2 is filled between the first fabric layer 11 and the second fabric layer 12 in the filling areas 10A to obtain a breathable bedding. Due to the fact that the production method does not require cutting the cover 1 to form hollow areas and sewing the mesh fabric with the cover 1, but directly conducts the air-permeable treatment to the breathable areas 10B, thereby obtaining the breathable areas 10B with air-permeable structure, not only the production process is simple, the production efficiency is high, and the production cost is saved (no cutting waste is generated, and there is also no need to provide additional mesh fabric), but also the cover 1 of the entire breathable bedding has an integrated structure, thereby improving the structural strength and aesthetics while also providing good breathability and heat dissipation functions.

As an implementation manner, the breathable bedding can be a breathable quilt, breathable pillow, or breathable mattress, preferably a breathable quilt.

As an implementation manner, the materials for the first fabric layer 11 and the second fabric layer 12 (i.e., the cover 1) can be various fabrics such as worsted fabric, cotton fabric, etc. The material for the cotton 2 can be various cotton materials such as down, cotton, synthetic fibers, blends, etc.

As an implementation manner, in step S11 above, the first fabric layer 11 and the second fabric layer 12 in the cover I can be simultaneously woven to form (the fabric is lifted in two layers at once, that is, two layers of fabric are woven simultaneously to form); alternatively, they can also be formed by weaving separately, and then the first fabric layer 11 and the second fabric layer 12 are stacked from top to bottom.

As an implementation manner, in step S11 above, the filling areas 10A and the breathable areas 10B are separated from each other, which may specifically be as follows. In a first method: when producing the cover 1, the first fabric layer 11 and the second fabric layer 12 in the cover 1 are simultaneously woven to form, and during the weaving process, the threads in the first fabric layer 11 and the second fabric layer 12 are interwoven at the periphery of the breathable areas 10B (that is, during the weaving process, the warp and weft threads are interwoven at a predetermined position), so as to connect the first fabric layer 11 and the second fabric layer 12 together at the periphery of the breathable areas 10B, thereby separating the filling areas 10A and the breathable areas 10B from each other. In a second method: after the first fabric layer 11 and the second fabric layer 12 in the cover 1 are stacked from top to bottom (in this case, the first fabric layer 11 and the second fabric layer 12 in the cover I can be woven simultaneously or separately), the periphery of the breathable areas 10B is sewn, so that the first fabric layer 11 and the second fabric layer 12 are connected together at the periphery of the breathable areas 10B, thereby separating the filling areas 10A and the breathable areas 10B from each other. The above first method is the preferred method.

Figure 2:
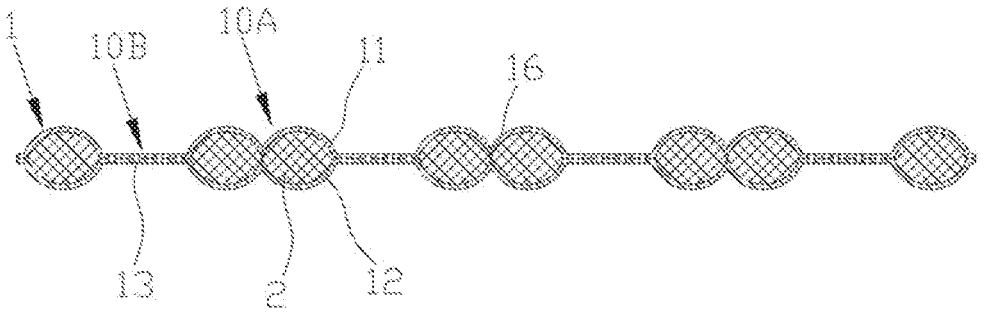
FIG. 2 is a cross-sectional schematic diagram along the A-A position in FIG. 1.
Figure 3:
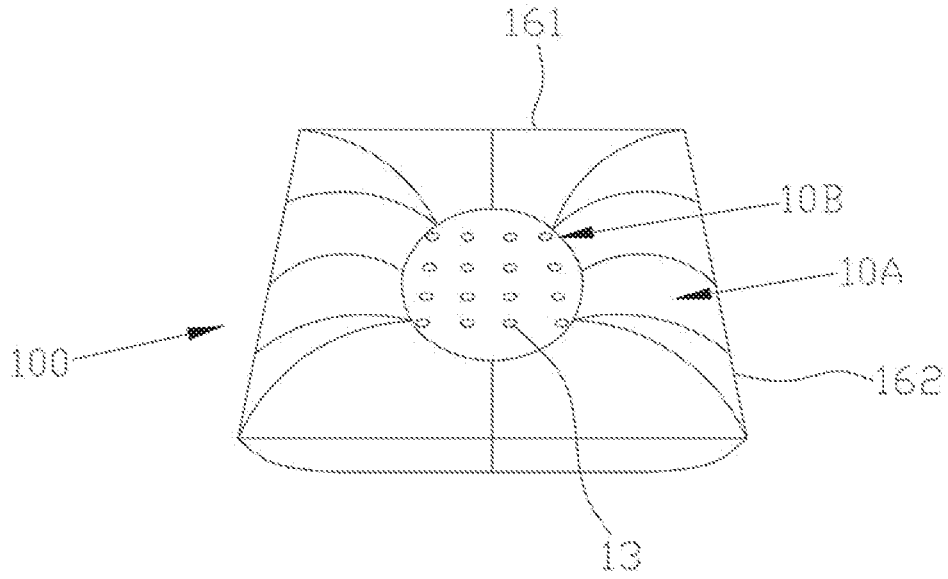
FIG. 3 is a schematic diagram of the three-dimensional structure of a single cell in FIG. 1.
Figure 4:
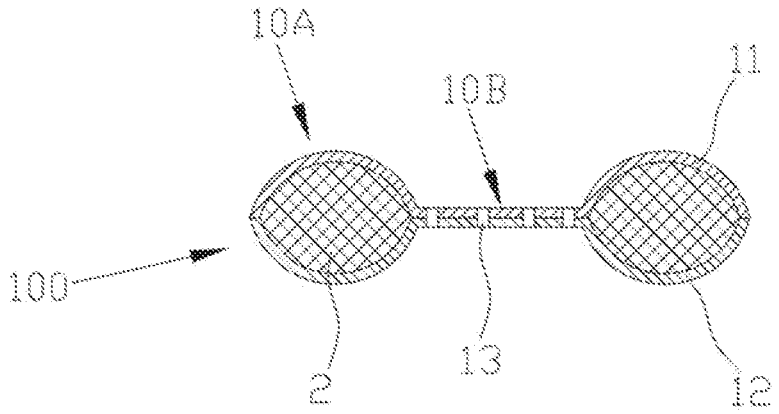
FIG. 4 is a cross-sectional schematic diagram of FIG. 3.

As shown in FIGS. 2 to 4, as an implementation manner, the thickness of the breathable areas 10B is smaller than that of the filling areas 10A, and the upper and lower sides of the breathable area 10B are inward recessed compared to the upper and lower sides of the filling area 10A. Meanwhile, the method for producing a breathable bedding may further include the following step: S15: conducting thermo-bonding treatment to the breathable areas 10B, so that the first fabric layer 11 and the second fabric layer 12 in the breathable areas 10B are thermally bonded together (during thermo-bonding, the first fabric layer 11 and the second fabric layer 12 will melt and bond together), whereas the filling areas 10A of the cover 1 are not subjected to thermo-bonding, and the first fabric layer 11 and the second fabric layer 12 in the filling areas 10A are not bonded to each other.

Specifically, due to filling of the cotton 2 between the first fabric layer 11 and the second fabric layer 12 in the filling areas 10A, while the breathable areas 10B are not filled with the cotton 2, the thickness of the breathable areas 10B is smaller than that of the filling areas 10A. Also, when the filling areas 10A are filled with the cotton 2, the cotton 2 expands upwards and downwards, so that the upper and lower sides of the breathable area 10B are inward recessed compared to the upper and lower sides of the filling area 10A. Meanwhile, due to the thermo-bonding treatment of the breathable areas 10B, the first fabric layer 11 and the second fabric layer 12 in the breathable areas 10B are bonded together, resulting in a smaller thickness of the breathable areas 10B, which has a smaller blocking effect on heat and gas. Thus, the breathable areas 10B are easier to dissipate heat and breathe, and further, air-permeable structure is formed in the breathable areas 10B, making the breathable areas 10B have better breathable and heat dissipation functions. However, in other embodiments, the breathable areas 10B may also not undergo the thermo-bonding treatment (that is, step S15 is omitted), and the first fabric layer 11 and the second fabric layer 12 in the breathable areas 10B are separated from each other.

As an implementation manner, the thermo-bonding treatment of the breathable areas 10B can be carried out before, after, or at the same time as the air-permeable treatment of the breathable areas 10B. The sequence of the thermo-bonding treatment and the air-permeable treatment of the breathable areas 10B is not limited. The breathable areas 10B can be subjected to the thermo-bonding treatment first, and then the breathable areas 10B are subjected to the air-permeable treatment; alternatively, the breathable areas 10B can be subjected to the air-permeable treatment first, and then the breathable areas 10B are subjected to the thermo-bonding treatment; alternatively, the breathable areas 10B can be subjected to both the thermo-bonding treatment and the air-permeable treatment at the same time (for example, conducting the thermo-bonding treatment while the air-permeable treatment is being carried out). Specifically, the thermo-bonding treatment of the breathable areas 10B can be achieved by applying a separate hot-pressing treatment to the breathable areas 10B, or by applying the thermo-bonding when the breathable areas 10B are being subjected to the air-permeable treatment (for example, if the air-permeable treatment is punching holes, and due to high temperature environment during punching holes, the first fabric layer 11 and the second fabric layer 12 in the breathable areas 10B will naturally be thermally bonded together at high temperature). Preferably, for ease of operation, the breathable areas 10B are subjected to the thermo-bonding treatment first, and then the breathable areas 10B are subjected to the air-permeable treatment (that is, step S15 is carried out before step S12); or the breathable areas 10B are subjected to the thermo-bonding treatment and the air-permeable treatment at the same time (that is, step S15 and step S12 are carried out simultaneously).

As an implementation manner, in step S12 above, the air-permeable treatment conducted to the breathable areas 10B can specifically include punching holes, laser cutting flowers, etc., to thereby form pores, slits or the like in the breathable areas 10B.

As shown in FIGS. 1 to 4, as an implementation manner, in step S12 above, conducting air-permeable treatment to the breathable areas 10B to form air-permeable structure in the breathable areas 10B, specifically includes: perforating (for example, using a punching machine for punching) the breathable areas 10B to form breathable holes 13 in the breathable areas 10B, wherein the breathable holes 13 penetrate through the first fabric layer 11 and the second fabric layer 12 from top to bottom in the breathable areas 10B.

As shown in FIGS. 1 to 4, as an implementation manner, each breathable area 10B is provided with multiple breathable holes 13, and the multiple breathable holes 13 are spaced apart from each other. The multiple breathable holes 13 can be arranged in an array or irregularly distributed. The shape of the breathable holes 13 can be circular, square, irregular, etc.

As shown in FIGS. 1 and 3, as an implementation manner, each breathable area 10B has a circular structure. However, in other embodiments, the breathable area 10B can also be in various shapes such as square or irregular.

Figure 6:
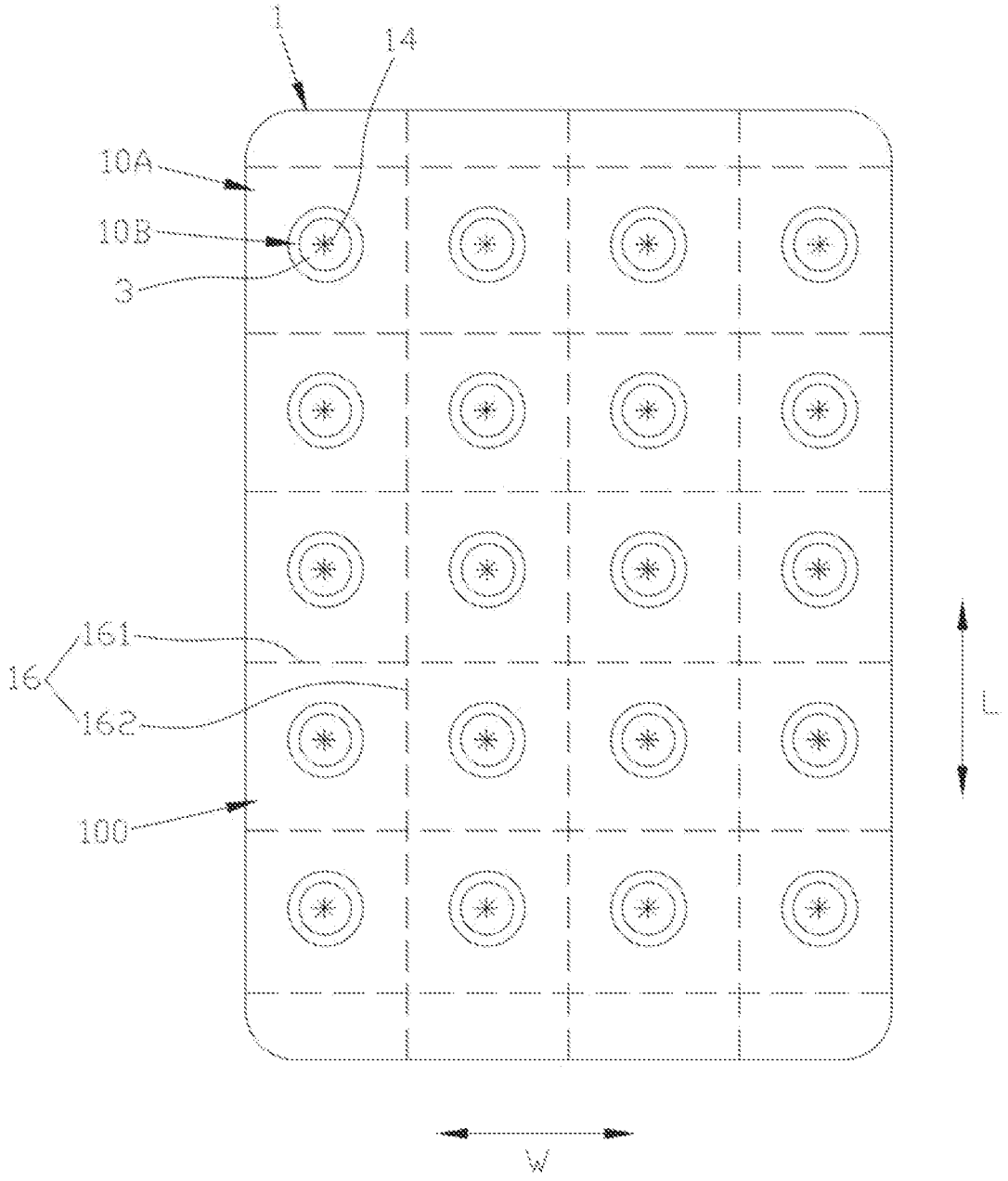
FIG. 6 is a schematic diagram of the planar structure of a breathable bedding in a further embodiment of the present application.

As shown in FIG. 6, as another implementation manner, in step S12 above, conducting air-permeable treatment to the breathable areas 10B to form air-permeable structure in the breathable areas 10B, specifically includes: cutting the breathable areas 10B (for example, cutting to form flowers) to form breathable slits 14 in the breathable areas 10B, wherein the breathable slits 14 penetrate through the first fabric layer 11 and the second fabric layer 12 from top to bottom in the breathable areas 10B.

Figure 7A:
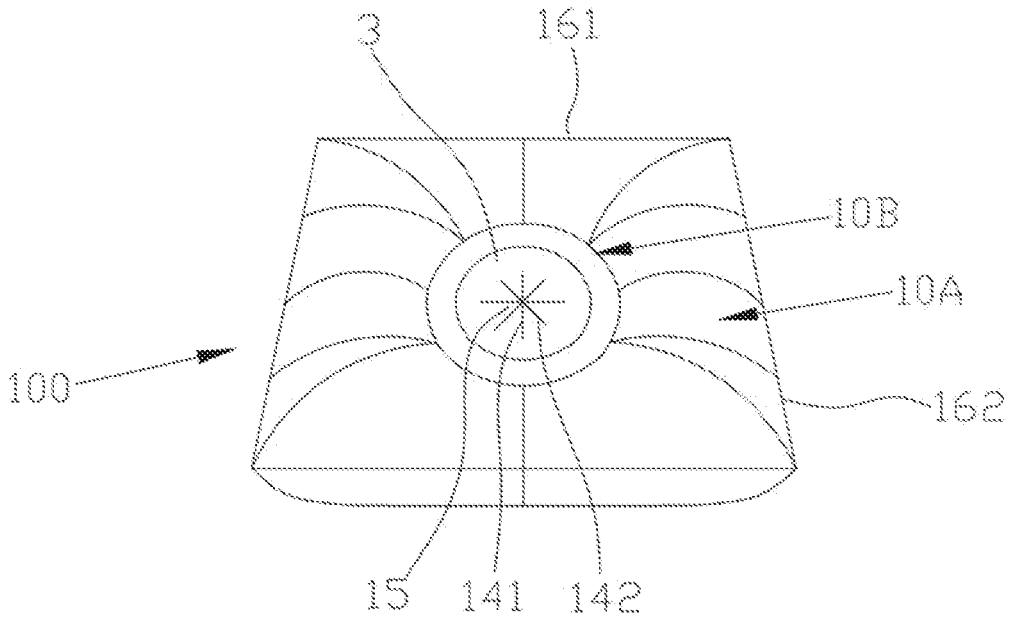
FIG. 7*a* is a schematic diagram of the three-dimensional structure of a single cell in FIG. 6 when the flipping portion is not flipped.
Figure 7B:
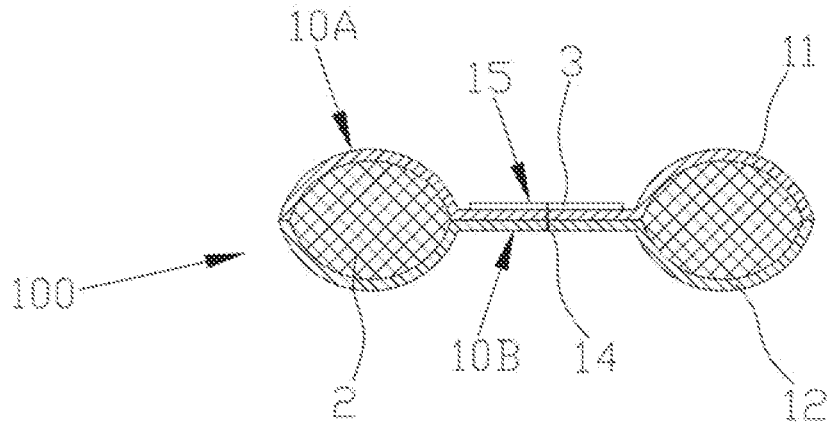
FIG. 7*b* is a cross-sectional schematic diagram of FIG. 7*a*.

As shown in FIGS. 6 to 7*b*, as an implementation manner, in step S12 above, before conducting the air-permeable treatment to the breathable areas 10B, the surface of each breathable area 10B is hot pressed with an adhesive film layer 3 (that is, a glue pressing process, or an offset printing process), and then the breathable area 10B and the adhesive film layer 3 are cut to form the breathable slits 14 simultaneously in the breathable area 10B and the adhesive film layer 3.

Specifically, due to the relatively soft material of the cover 1 (including the first fabric layer 11 and the second fabric layer 12), if the breathable areas 10B of the cover 1 are directly cut, there may be burrs occurred at the cutting positions (i.e., at the positions of the breathable slits 14), which not only affects the aesthetics, but also the burrs may become larger after long-term use, thereby affecting the service life of the breathable bedding. Therefore, in this embodiment, the surface of each breathable area 10B is first hot pressed with an adhesive film layer 3, and then the breathable area 10B and the adhesive film layer 3 are cut to avoid burrs. Meanwhile, the adhesive film layer 3 can increase aesthetics and have a certain hard feel when touched, thereby increasing the user's experience of use. The size of the adhesive film layer 3 can be the same as the size of the breathable area 10B (that is, the adhesive film layer 3 fully covers the breathable area 10B), or smaller than the size of the breathable area 10B (as shown in FIG. 6 and FIG. 7*a*, the size of the adhesive film layer 3 is smaller than the size of the breathable area 10B, that is, the adhesive film layer 3 does not fully cover the breathable area 10B). However, in other embodiments, it is also possible to punch holes in the breathable area 10B and the adhesive film layer 3, thereby forming breathable holes 13 in the breathable area 10B and the adhesive film layer 3; alternatively, the breathable slits 14 and the breathable holes 13 can be formed simultaneously in the breathable area 10B and the adhesive film layer 3.

As shown in FIGS. 7*a* to 8*b*, as an implementation manner, the breathable slits 14 include a first breathable slit 141 and a second breathable slit 142 which are arranged in a mutually intersecting manner. The breathable area 10B and the adhesive film layer 3 form a flipping portion 15 at the intersection of the first breathable slit 141 and the second breathable slit 142. In this embodiment, there are three breathable slits 14 in each breathable area 10B, and the three breathable slits 14 intersect with each other to form a "K" shaped structure. However, in other embodiments, there can be also two breathable slits 14 in each breathable area 10B, and the two breathable slits 14 intersect with each other to form a "f" shaped structure or an "X" shaped structure. However, in other embodiments, more breathable slits 14 can be set in each breathable area 10B.

Figure 8A:
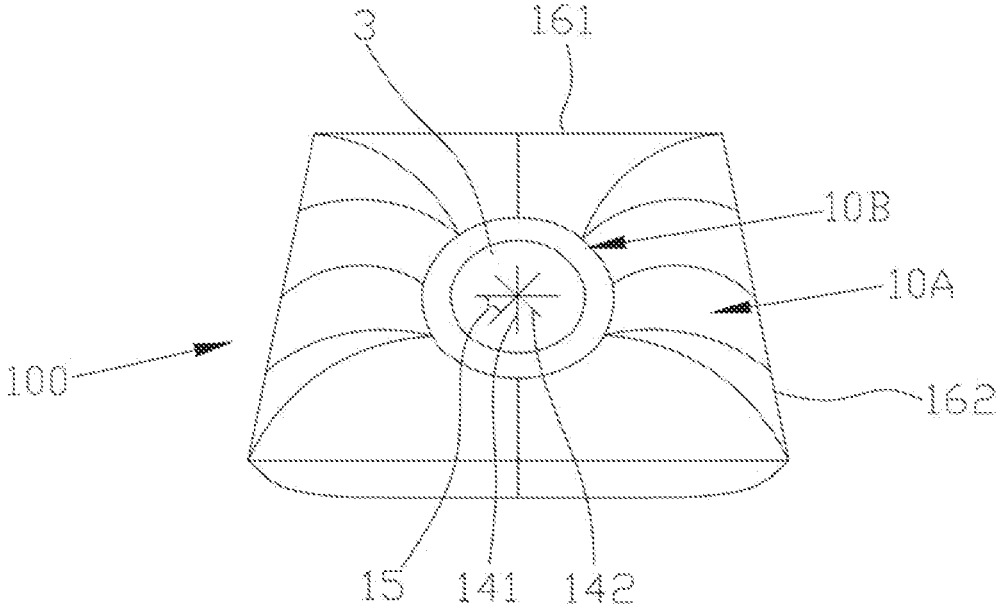
FIG. 8*a* is a schematic diagram of the three-dimensional structure of a single cell in FIG. 6 after the flipping portion is flipped open.
Figure 8B:
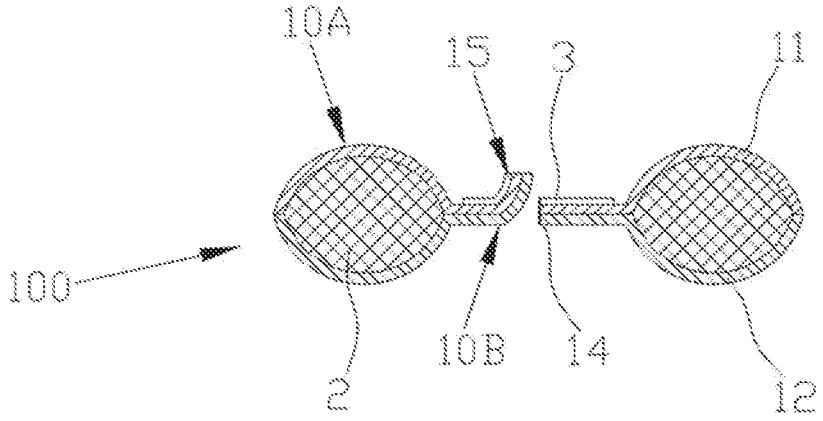
FIG. 8*b* is a cross-sectional schematic diagram of FIG. 8*a*.

Specifically, due to the intersecting arrangement of the first breathable slit 141 and the second breathable slit 142, a flipping portion 15 will be formed at the intersection of the two. As shown in FIGS. 7*a* and 7*b*, when the flipping portion 15 is not flipped, the breathable slits 14 have an elongated narrow gap structure, and the amount of breathable heat dissipation is relatively small in this situation. As shown in FIGS. 8*a* and 8*b*, when the flipping portion 15 is flipped (i.e., the flipping portion 15 is folded upwards or downwards), a relatively large breathable hole structure will be formed in the breathable area 10B at the flipping position of the flipping portion 15, thereby increasing the amount of breathable heat dissipation and improving the breathable heat dissipation effect. However, in other embodiments, the breathable slits 14 can also be non-intersecting narrow gap structure.

However, in other embodiments, other forms of air-permeable treatment can be conducted to the breathable areas 10B to form other forms of air-permeable structure.

As an implementation manner, the material of the first fabric layer 11 and the second fabric layer 12 (i.e., the cover 1) is ultrasonic fabric. Ultrasonic fabric is a type of waterproof and breathable fabric, which is composed of polymer waterproof and breathable materials combined with traditional fabrics. Therefore, it has a certain degree of breathable and heat dissipation function, further improving the breathable and heat dissipation effect of the breathable bedding.

As shown in FIG. 1, as an implementation manner, the cover 1 is provided with multiple breathable areas 10B, the multiple breathable areas 10B are arranged in an array on the cover 1, and adjacent two breathable areas 10B are separated by the filling areas 10A, thereby improving the breathable heat dissipation effect and aesthetics of the breathable bedding.

As shown in FIG. 1, as an implementation manner, the cover 1 has a square structure, and the cover 1 has a length direction L and a width direction W. The multiple breathable areas 10B are arranged in an array on the cover I along the length direction L and the width direction W. However, in other embodiments, the cover 1 can also be of other shapes, such as circular or irregular, and the distribution of the breathable areas 10B can also be adaptively changed according to the shape of the cover 1.

As shown in FIGS. 1 and 2, as an implementation manner, in step S13 above, after filling the cotton 2 between the first fabric layer 11 and the second fabric layer 12 in the filling areas 10A, the first fabric layer 11 and the second fabric layer 12 in the filling areas 10A are further sewn with sewing lines 16 to fix the cotton 2 between the first fabric layer 11 and the second fabric layer 12 in the filling areas 10A, to avoid the phenomena of aggregation and uneven distribution of the cotton 2 (i.e., gathering together) during subsequent use. In addition, the sewing lines 16 can also improve aesthetics.

As shown in FIGS. 1 to 4, as an implementation manner, the sewing lines 16 are located between adjacent breathable areas 10B. The sewing lines 16 include multiple first sewing lines 161 extending horizontally and multiple second sewing lines 162 extending vertically (in this embodiment, the first sewing lines 161 extend along the width direction W of the cover 1, and the second sewing lines 162 extend along the length direction L of the cover 1). The breathable bedding is comprised of multiple cells 100 formed by the multiple first sewing lines 161 intersecting with the multiple second sewing lines 162, and the multiple breathable areas 10B are respectively located within the multiple cells 100. The breathable area 10B in each cell 100 is surrounded by the filling area 10A, and each cell 100 is a structure with a depression in the middle and a protrusion at the periphery (the thinner breathable area 10B is located in the middle of the cell 100, and the thicker filling area 10A is located at the periphery of the cell 100, thereby forming a structure with a depression in the middle and a protrusion at the periphery). Meanwhile, the filling areas 10A in the various cells 100 form multiple independent small chambers (that is, the internal spaces of the filling areas 10A are divided by the sewing lines 16 to form multiple small chambers, and the cotton 2 is filled into each small chamber, thereby avoiding the phenomena of aggregation and uneven distribution of the cotton 2).

Figure 5:
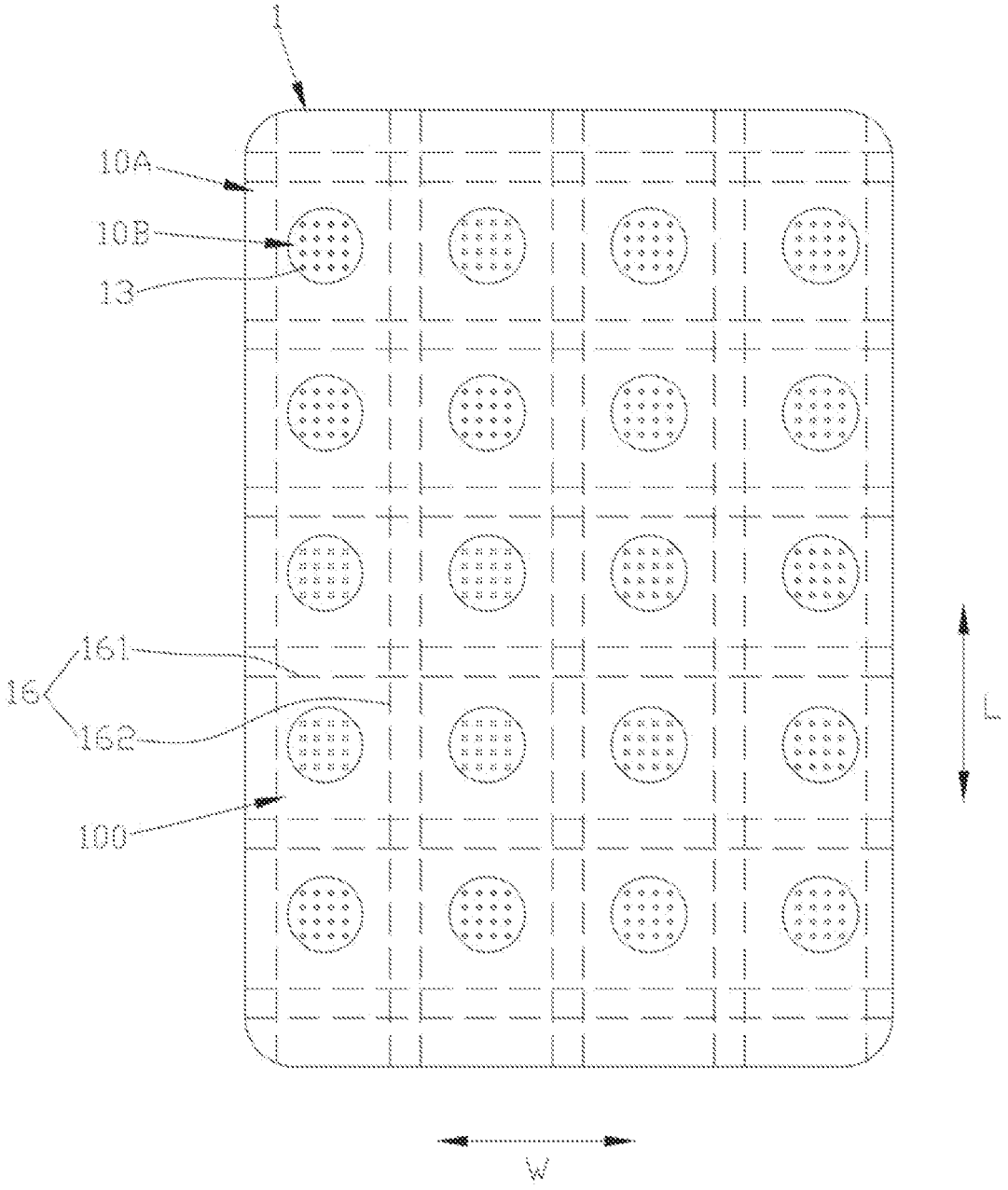
FIG. 5 is a schematic diagram of the planar structure of a breathable bedding in another embodiment of the present application.

As shown in FIG. 1, as an implementation manner, there are a first sewing line 161 and a second sewing line 162 between adjacent breathable areas 10B. As shown in FIG. 5, as another implementation manner, there are two first sewing lines 161 and two second sewing lines 162 between adjacent breathable areas 10B. However, in other embodiments, the number of the first sewing line 161 and the second sewing line 162 may be more. Meanwhile, in this embodiment, the sewing line 16 is a linear structure. However, in other embodiments, the sewing line 16 can also be in the form of a broken line, a curved line, or the like.

As an implementation manner, in step S14 above, the first fabric layer 11 and the second fabric layer 12 at the edge of the cover 1 are sewn. Specifically, an edge wrapping, edge rolling, sewing or double sealing process can be used to the first fabric layer 11 and the second fabric layer 12 at the peripheral edge of the cover 1.

It should be noted that the term "sewing" described in this embodiment includes but is not limited to manual sewing, mechanical sewing, knotting, and other processes.

Figure 9A:
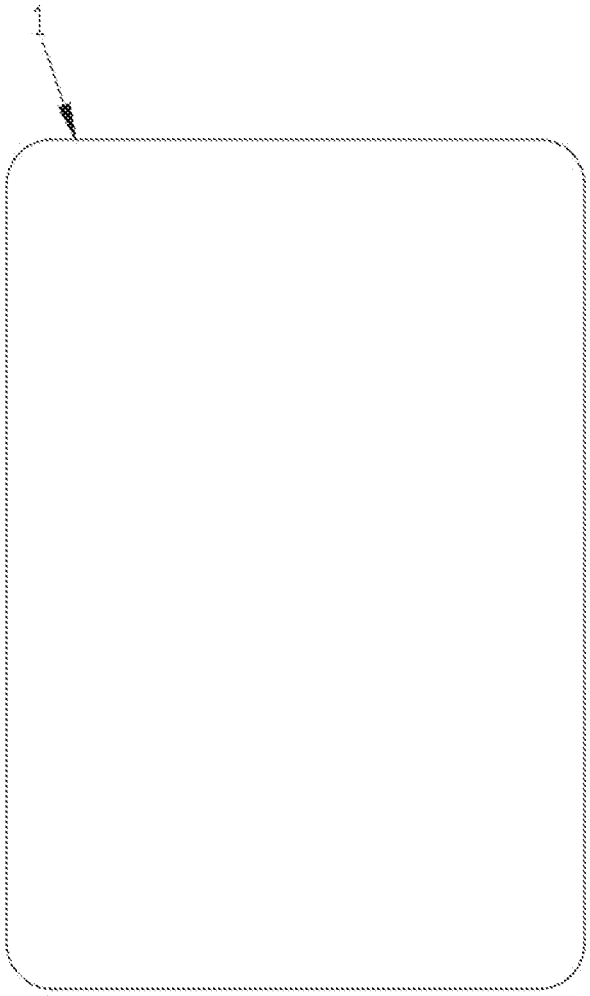
FIGS. 9*a* to 12*b* are schematic diagrams illustrating the production process of a breathable bedding in an embodiment of the present application.
Figure 9B:
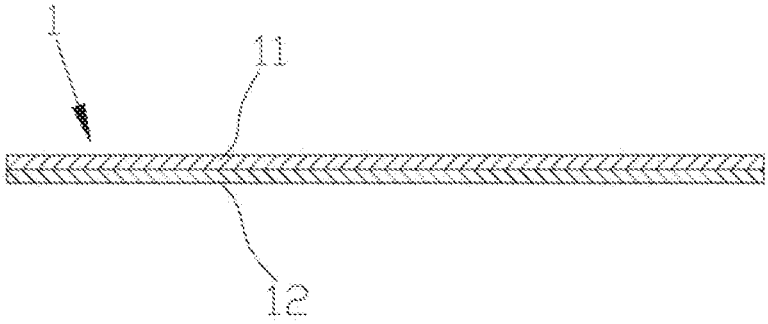

FIGS. 9*a* to 12*b* are schematic diagrams of the production process of the breathable bedding in the embodiments of the present application. Specifically, FIGS. 9*a*, 10*a*, 1*la*, and 12*a* are all schematic diagrams of the planar structure of the breathable bedding, while FIGS. 9*b*, 10*b*, 11*b*, and 12*b* are cross-sectional schematic diagrams of FIGS. 9*a*, 10*a*, 11*a*, and 12*a*, respectively. As shown in FIGS. 9*a* to 12*b*, as an implementation manner, specific steps for producing a breathable bedding can be as follows:

(1) As shown in FIGS. 9*a* and 9*b*, a cover 1 is produced, wherein the cover 1 includes a first fabric layer 11 and a second fabric layer 12 which are stacked from top to bottom, the cover 1 is divided into filling areas 10A and breathable areas 10B, and during the process of producing the cover 1, the filling areas 10A and the breathable areas 10B are separated from each other (the filling areas 10A and the breathable areas 10B are not shown in FIGS. 9*a* and 9*b*).

Figure 10A:
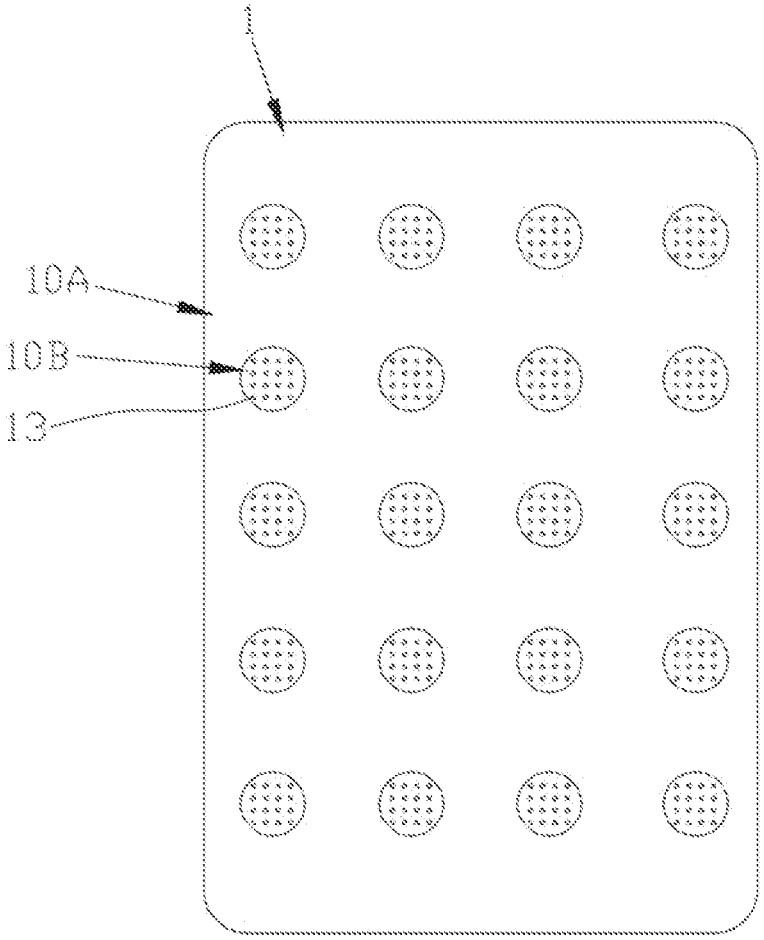
Figure 10B:
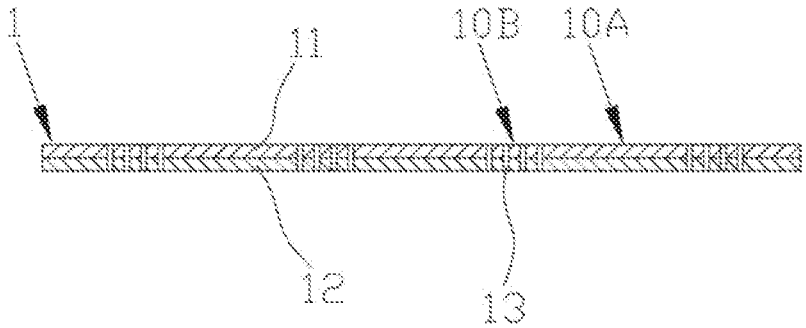
Figure 11A:
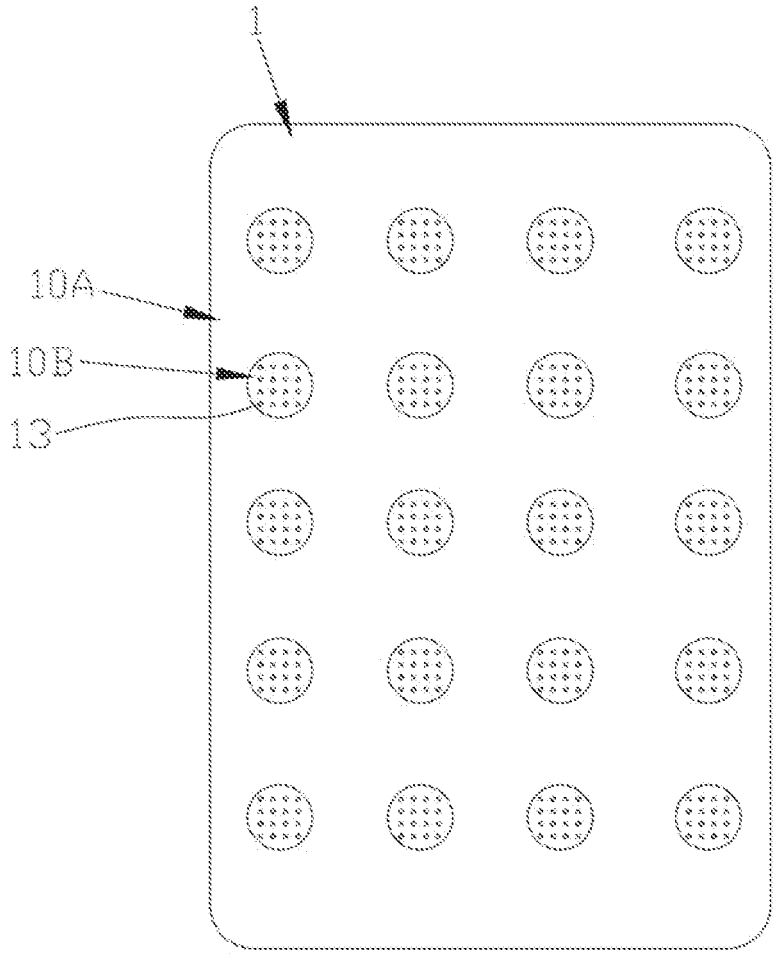
Figure 11B:
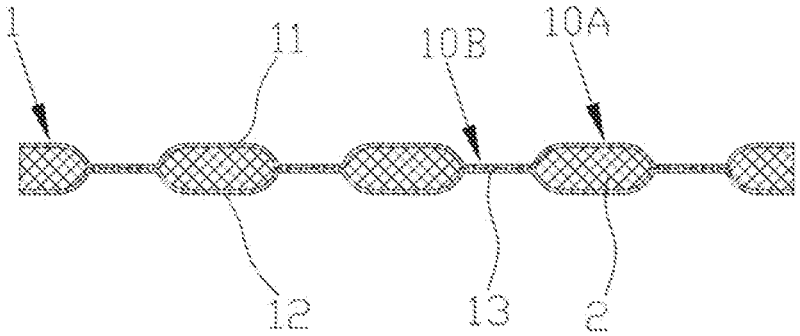

(2) As shown in FIGS. 10*a* and 10*b*, the breathable areas 10B of the cover 1 are subjected to hot pressing, so that the first fabric layer 11 and the second fabric layer 12 in the breathable areas 10B are bonded together, whereas the filling areas 10A of the cover 1 are not subjected to hot pressing, and the first fabric layer 11 and the second fabric layer 12 in the filling areas 10A are not bonded to each other. Then, the breathable areas 10B are perforated to form breathable holes 13, and the breathable holes 13 penetrate through the first fabric layer 11 and the second fabric layer 12 in the breathable areas 10B.

(3) As shown in FIGS. 1*la* and 11*b*, cotton 2 is evenly filled between the first fabric layer 11 and the second fabric layer 12 in the filling areas 10A through an opening between the first fabric layer 11 and the second fabric layer 12 at the edge of the cover 1.

Figure 12A:
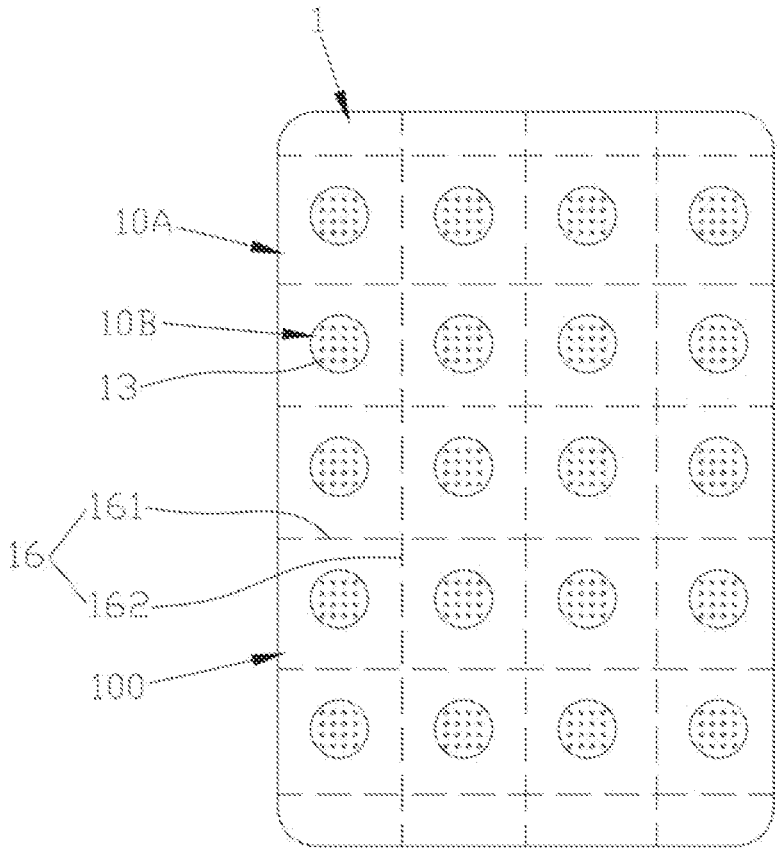
Figure 12B:
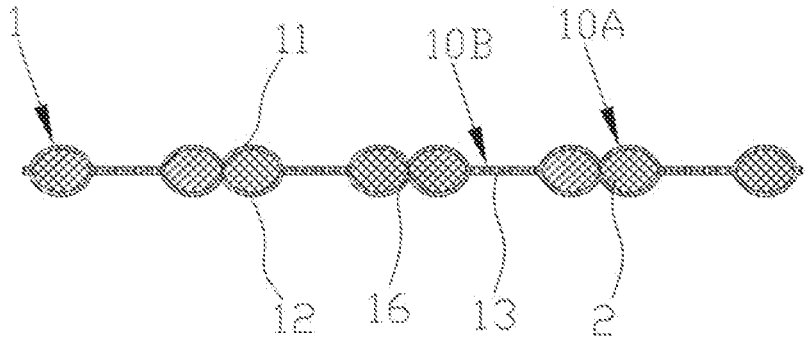

(4) As shown in FIGS. 12*a* and 12*b*, the first fabric layer 11 and the second fabric layer 12 in the filling areas 10A are horizontally and vertically sewn using sewing lines 16 to fix the cotton 2 between the first fabric layer 11 and the second fabric layer 12 in the filling areas 10A. The sewing lines 16 include multiple first sewing lines 161 extending horizontally and multiple second sewing lines 162 extending vertically, the multiple first sewing lines 161 and the multiple second sewing lines 162 intersect with each other to form multiple cells 100, and the multiple breathable areas 10B are respectively located within the multiple cells 100. Then, the first fabric layer 11 and the second fabric layer 12 at the edge of the cover 1 are sewn to obtain a breathable bedding.

Figure 13:
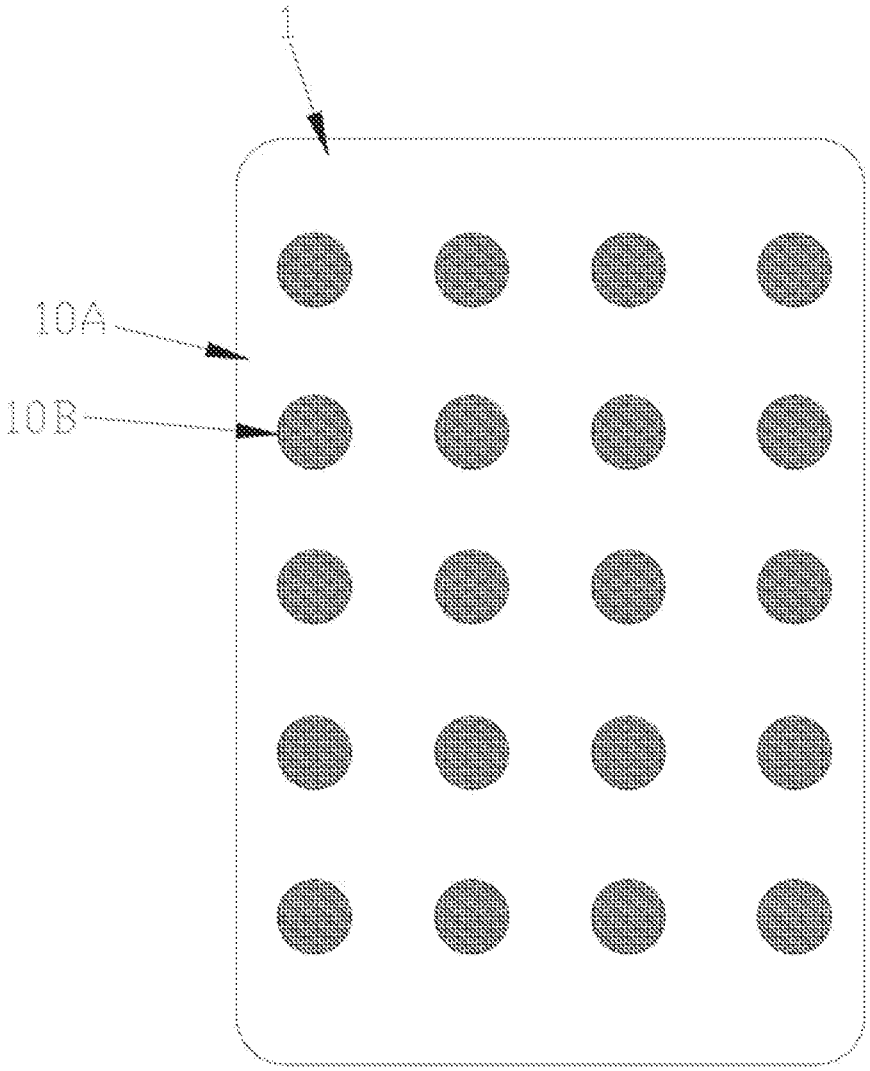
FIG. 13 is a schematic diagram of the planar structure of the cover in another embodiment of the present application.

The embodiment of the present application further provides another method for producing a breathable bedding, including the following steps:

S21: producing a cover 1, wherein the cover 1 is produced by weaving, the cover 1 includes a first fabric layer 11 and a second fabric layer 12 which are stacked from top to bottom, the cover 1 is divided into filling areas 10A and breathable areas 10B, the filling areas 10A and the breathable areas 10B are separated from each other, and air-permeable structure is formed on the first fabric layer 11 and the second fabric layer 12 in the breathable areas 10B during the weaving process (As shown in FIG. 13, air-permeable structure is already formed in the breathable areas 10B of the cover I during the weaving process, so that no further air-permeable treatment is required for the breathable areas 10B in the future. However, air-permeable treatment to the breathable areas 10B can also be carried out in the future to increase the breathability of the breathable areas 10B, and the methods of air-permeable treatment are the same as above and will not be repeated here);

S23: filling cotton 2 between the first fabric layer 11 and the second fabric layer 12 in the filling areas 10A; and S24: sewing the first fabric layer 11 and the second fabric layer 12 at the edge of the cover 1 to obtain a breathable bedding.

Specifically, in this embodiment, in step S21 above, the air-permeable structure on the first fabric layer 11 and the second fabric layer 12 in the breathable areas 10B can be obtained through jacquard weaving process, and the air-permeable structure can be a structure such as breathable holes 13. Due to the formation of air-permeable structure during the weaving process, therefore, no further air-permeable treatment is required for the breathable areas 10B in the future, thereby improving the production efficiency. Except for the step of forming air-permeable structure in the breathable areas 10B which is different from the above embodiments, the other steps of this embodiment (including thermo-bonding, filling cotton 2, sewing, etc.) and the formed structure in this embodiment are the same as the above embodiments, and will not be repeated here.

The embodiment of the present application further provides a breathable bedding, which is produced using the method for producing a breathable bedding as described above.

As an implementation manner, the breathable bedding can be a breathable quilt, breathable pillow, or breathable mattress, preferably a breathable quilt.

In the method for producing a breathable bedding provided in the embodiment, the cover 1 is divided into filling areas 10A and breathable areas 10B, the breathable areas 10B of the cover 1 are subjected to thermos-bonding treatment, so that the first fabric layer 11 and the second fabric layer 12 in the breathable areas 10B are bonded together, whereas the filling areas 10A of the cover 1 are not subjected to thermos-bonding treatment, and the first fabric layer 11 and the second fabric layer 12 in the filling areas 10A are not bonded to each other; and air-permeable treatment is conducted to the breathable areas 10B to form air-permeable structure in the breathable areas 10B. Then, the cotton 2 is filled between the first fabric layer 11 and the second fabric layer 12 in the filling areas 10A to obtain a breathable bedding. Due to the fact that the production method does not require cutting the cover 1 to form hollow areas and sewing the mesh fabric with the cover 1, but directly conducts thermos-bonding treatment and air-permeable treatment to the breathable areas 10B, thereby obtaining the breathable areas 10B with air-permeable structure, not only the production process is simple, the production efficiency is high, and the production cost is saved (no cutting waste is generated, and there is also no need to provide additional mesh fabric), but also the cover 1 of the entire breathable bedding has an integrated structure, thereby improving the structural strength and aesthetics while also providing good breathability and heat dissipation functions.

The above are only the specific embodiments of the present application, but the scope of protection of the present application is not limited to this. Any technical personnel familiar with this technical field who can easily think of changes or replacements within the scope of technology disclosed in the present application should be covered within the scope of protection of the present application. Therefore, the protection scope of the present application should be based on the protection scope of the claims.

What is claimed is:

1. A method for producing a breathable bedding, comprising the following steps:

producing a cover (1), wherein the cover (1) comprises a first fabric layer (11) and a second fabric layer (12) which are stacked from top to bottom, the cover (1) is divided into filling areas (10A) and breathable areas (10B), and the filling areas (10A) and the breathable areas (10B) are separated from each other;

conducting thermo-bonding treatment to the breathable areas (10B), such that the first fabric layer (11) and the second fabric layer (12) in the breathable areas (10B) are thermally bonded together, whereas the filling areas (10A) of the cover (1) are not subjected to thermo-bonding treatment, and the first fabric layer (11) and the second fabric layer (12) in the filling areas (10A) are not bonded to each other;

conducting air-permeable treatment to the breathable areas (10B) to form air-permeable structure in each of the breathable areas (10B), wherein the air-permeable structure is comprised of multiple breathable holes (13) or breathable slits (14) penetrating through the first fabric layer (11) and the second fabric layer (12) from top to bottom in each of the breathable areas (10B);

filling cotton (2) between the first fabric layer (11) and the second fabric layer (12) in the filling areas (10A);

sewing the first fabric layer (11) and the second fabric layer (12) in the filling areas (10A) with sewing lines (16) to fix the cotton (2) in the filling areas (10A), wherein the sewing lines (16) comprise multiple first sewing lines (161) and multiple second sewing lines (162), the breathable bedding is comprised of multiple cells (100) formed by the multiple first sewing lines (161) intersecting with the multiple second sewing lines (162), each cell (100) is comprised of a breathable area (10B) located in a middle of the cell (100) and a filling area (10A) surrounding a periphery of the breathable area (10B), such that the multiple breathable holes (13) or breathable slits (14) in the breathable area (10B) of each cell (100) is surrounded by the filling area (10A) of the cell (100); and sewing the first fabric layer (11) and the second fabric layer (12) at the edge of the cover (1) to obtain a breathable bedding.

2. The method for producing a breathable bedding as claimed in claim 1, wherein said conducting air-permeable treatment to the breathable areas (10B) to form air-permeable structure in each of the breathable areas (10B), specifically comprises:

perforating the breathable areas (10B) to form the multiple breathable holes (13) in each of the breathable areas (10B).

3. The method for producing a breathable bedding as claimed in claim 1, wherein said conducting air-permeable treatment to the breathable areas (10B) to form air-permeable structure in each of the breathable areas (10B), specifically comprises:

cutting the breathable areas (10B) to form the multiple breathable slits (14) in each of the breathable areas (10B).

4. The method for producing a breathable bedding as claimed in claim 3, wherein before conducting air-permeable treatment to the breathable areas (10B), the surface of each breathable area (10B) is hot pressed with an adhesive film layer (3), and then the breathable area (10B) and the adhesive film layer (3) are cut to form the multiple breathable slits (14) simultaneously in the breathable area (10B) and the adhesive film layer (3).

5. The method for producing a breathable bedding as claimed in claim 3, wherein the multiple breathable slits (14) comprise a first breathable slit (141) and a second breathable slit (142) which are arranged in a mutually intersecting manner, and the breathable area (10B) forms a flipping portion (15) at the intersection of the first breathable slit (141) and the second breathable slit (142).

6. The method for producing a breathable bedding as claimed in claim 1, wherein the breathable areas (10B) are subjected to the thermo-bonding treatment first, and then the breathable areas (10B) are subjected to the air-permeable treatment; or the breathable areas (10B) are subjected to the thermo-bonding treatment and the air-permeable treatment at the same time.

7. The method for producing a breathable bedding as claimed in claim 1, wherein the cover (1) is provided with multiple breathable areas (10B), the multiple breathable areas (10B) are arranged in an array on the cover (1), and adjacent two breathable areas (10B) are separated by the filling areas (10A).

8. The method for producing a breathable bedding as claimed in claim 1, wherein the thickness of the breathable areas (10B) is less than the thickness of the filling areas (10A), and the upper and lower sides of the breathable area (10B) are inward recessed compared to the upper and lower sides of the filling area (10A).

9. The method for producing a breathable bedding as claimed in claim 1, wherein the cover (1) is provided with multiple breathable areas (10B), the multiple breathable areas (10B) are arranged in an array on the cover (1), and adjacent two breathable areas (10B) are separated by the filling areas (10A); the sewing lines (16) are located between adjacent breathable areas (10B), the multiple first sewing lines (161) extend horizontally and the multiple second sewing lines (162) extend vertically, the multiple breathable areas (10B) are respectively located within the multiple cells (100), and each cell (100) is a structure with a depression in the middle of the cell (100) and a protrusion at the periphery of the cell (100).

10. A breathable bedding which is produced using the method for producing a breathable bedding as claimed in claim 1.

11. The breathable bedding as claimed in claim 10, wherein the breathable bedding is a breathable quilt, breathable pillow, or breathable mattress.

* * * * *